US005788479A

United States Patent [19]

Galanos et al.

[11] Patent Number: 5,788,479

[45] Date of Patent: Aug. 4, 1998

[54] LIGHTER HOLDER

[76] Inventors: Kelly K. Galanos; Maria Martella, both of P.O. Box 206, Troy, Mich. 48099

[21] Appl. No.: 812,318

[22] Filed: Mar. 5, 1997

[51] Int. Cl.[6] ..... F23D 11/36

[52] U.S. Cl. ..... 431/253; 431/343; 206/87

[58] Field of Search ..... 431/253, 343, 431/344; 248/682, 229.17, 205.2; 362/105, 106, 190, 191; 206/85–95

[56] References Cited

U.S. PATENT DOCUMENTS

| | | | |
|---|---|---|---|
| 1,720,589 | 7/1929 | Danab | 206/94 |
| 2,536,721 | 1/1951 | Caldwell | 206/94 |
| 2,769,219 | 11/1956 | Elkavich | 206/87 |
| 4,718,126 | 1/1988 | Slay | 362/105 |
| 4,797,793 | 1/1989 | Fields | 362/105 |

*Primary Examiner*—James C. Yeung

[57] ABSTRACT

A lighter holder to releasably attach a cigarette lighter to a cigarette pack comprises a first portion that defines a first closed loop and a second portion that defines a second closed loop. The first portion is constructed of an elastic material that may be stretched from its original size and configuration to circumscribe a perimeter of a preselected cigarette pack, and returns to substantially its original size and configuration when removed from the preselected cigarette pack. The second portion is constructed of an elastic material that may be stretched from its original size and configuration to circumscribe a perimeter of a preselected cigarette lighter, and returns to substantially its original size and configuration when removed from the cigarette lighter. The second loop is connected with the first loop.

2 Claims, 2 Drawing Sheets

FIG. 3
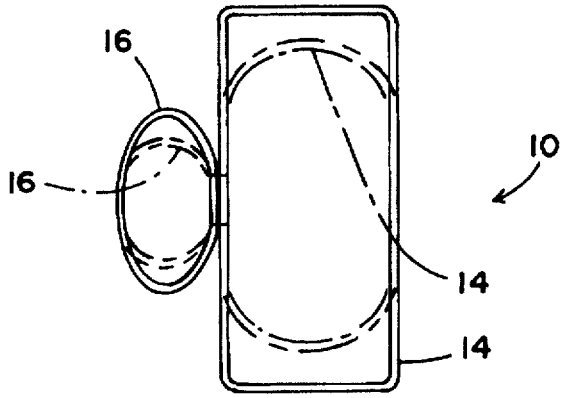
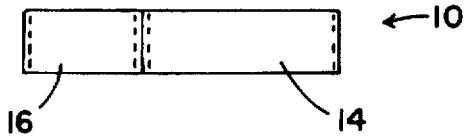
FIG. 4
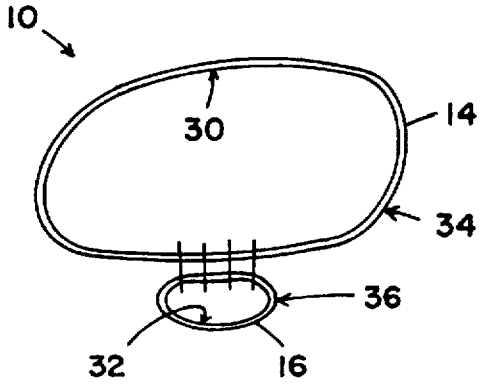
FIG. 5
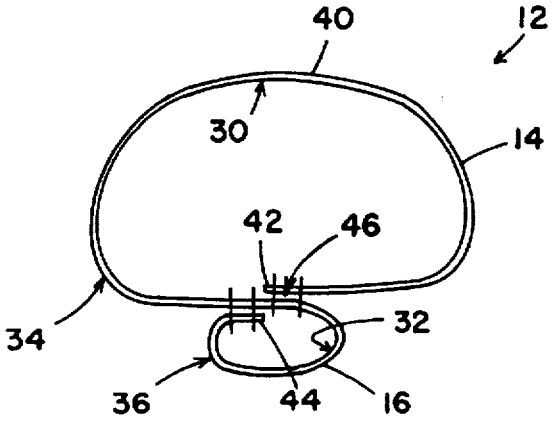
FIG. 6

LIGHTER HOLDER

CROSS-REFERENCE TO RELATED APPLICATION

This application claims the benefit of U.S. provisional patent application Ser. No. 60/013,075 filed on Mar. 8, 1996.

BACKGROUND OF THE INVENTION

The invention relates to retention devices to hold a cigarette lighter releasably connected with a cigarette pack and the like.

BRIEF DESCRIPTION OF THE DRAWINGS

FIG. 3 is a top plan view of the holder of FIG. 2;

FIG. 4 is a side-elevational view of the holder of FIG. 2;

FIG. 5 is an exploded, top plan view of the holder of FIG. 2;

FIG. 6 is the view of FIG. 5, showing a alternative construction.

DESCRIPTION OF THE PREFERRED EMBODIMENTS

Figure 1:
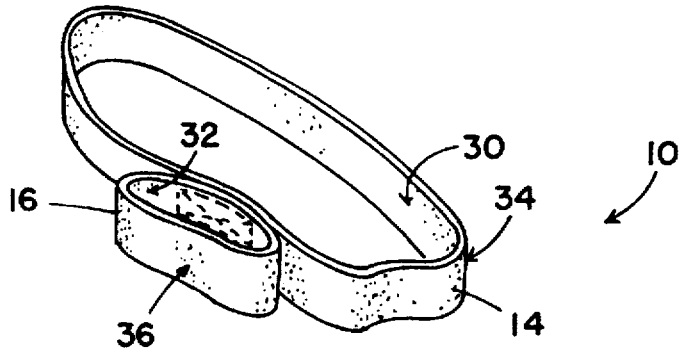
FIG. 1 is a top perspective view of a lighter holder according to the invention.
Figure 2:
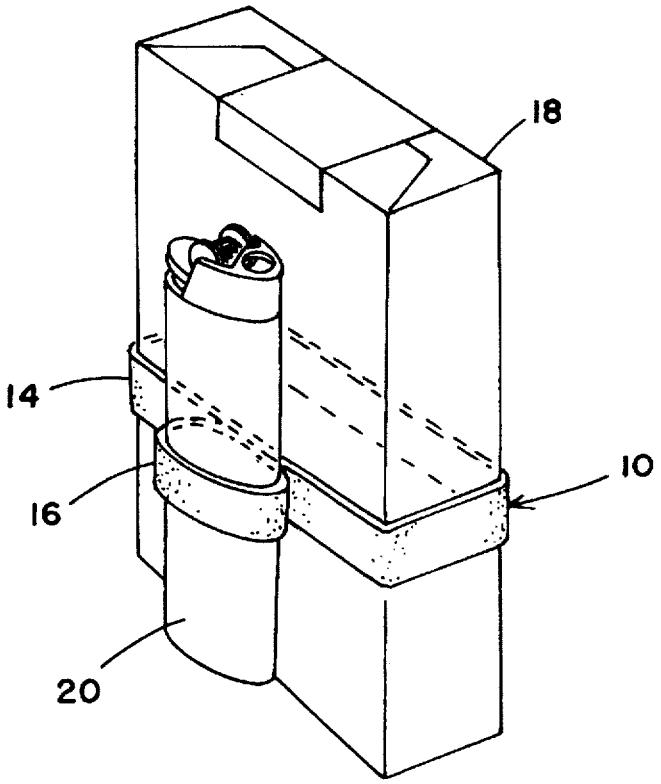
FIG. 2 is the view of FIG. 1, showing the invention installed and in use.

A lighter holder according to the invention is generally shown in the drawing figures and identified by the reference numeral 10 in FIGS. 1–5. An alternative embodiment of a lighter holder according to the invention, with an alternative construction, is shown in drawing FIG. 6 and is identified by the reference number 12.

The lighter holder 10 is a unitary device that has a large loop 14 and a small loop 16 to define a generally figure eight shaped member. Each of the large loop 14 and the small loop 16 may be made of any suitable, elastic material, including neoprene rubber, for example, as is commonly found for various accessory items or products in the marketplace.

The large loop 14 is sized for a snug, slip-resistant fit around a package of cigarettes 18 or the like, which commonly have an about six inch (154.2 mm) outside circumference. The large loop 14 may be an open ended strap with cooperating fastener members at opposing ends of the strap, the strap being wrapped around the cigarette pack or the like, and the opposing ends fastened together to secure the strap to the pack. The large loop 14 is, however, most preferably a closed loop to maximize reliability and convenience of use. Thus, large loop 14 may be initially formed as a seamless, closed loop or may be constructed as a loop by attaching together the opposing free ends of an open strap of suitable material, discussed further above, by sewing or the use of an adhesive, for example.

Similarly, the small loop 16 is sized for a snug, slip-resistant fit around the various disposable or refillable lighters 20 that are commonly found in the marketplace, which commonly have an about two inch (50.8 mm) outside circumference. The small loop 16 may also be an open ended strap with cooperating fastener members at opposing ends of the strap, the strap being wrapped around the lighter 20 or the like, and the opposing ends fastened together to secure the strap to the lighter. The small loop 16 is, however, most preferably a closed loop to maximize reliability and convenience of use. Thus, small loop 16 may be initially formed as a seamless, closed loop or may be constructed as a loop by attaching together the opposing free ends of an open strap of suitable material, discussed further above, by sewing or the use of an adhesive, for example.

Each of the large loop 14 and the small loop 16 has an interior surface 30, 32 respectively, and an exterior surface 34, 36 respectively. Each or any of the interior and exterior surfaces of the large and small loops may be provided with decorative design or texture and the like. A decorative design or texture may be selected to provide an appealing visual impression. Also, each or any of the interior and exterior surfaces of the large and small loops may be provided with enhanced grasping qualities to minimize slippage of the lighter holder 10 relative to the pack 18 or the lighter 20, to maximize a user's grasp of lighter holder 10 and the enclosed pack 18 or lighter 20, or to minimize sliding of lighter holder 10 and the enclosed pack 18 or lighter 20 on a surface, for example. The application of an aesthetic or friction enhancing treatment to each of the interior and exterior surfaces 30–36, respectively, of the large 14 and small 16 loops may be applied in any combination.

As is generally shown in the drawing FIGS. 1–5, lighter holder 10 may be constructed by attaching a small loop 16 to a large loop 14 by sewing or the use of an adhesive, for example. In this construction, each of the large loop 14 and the small loop 16 is preferably a seamless, closed loop member, as is discussed in greater detail above.

In the alternative embodiment 12 of a lighter holder according to the invention (FIG. 6), a single strap 40 of material is arranged in a generally figure-eight shape, or closed S-shaped configuration with the opposing tails 42 and 44 of the S being brought into close proximity, on opposing sides of a mid-portion 46 of the strap. Each of the ends 42 and 44 of the strap 40 are attached to the mid-portion 46 by sewing or by the use of an appropriate adhesive, for example.

In use, the large loop 14 is manually expanded by a user and placed around the cigarette pack 18 or the like to circumscribe and grasp the pack. A lighter 20 or the like is inserted into and grasped by the small loop 16, thereby releasably joining and keeping the two articles together.

It will be understood by those who practice the invention and by one skilled in the art, that various modifications and improvements may be made without departing from the spirit of the disclosed concept. The scope of protection afforded is to be determined by the claims and by the breadth of interpretation allowed by law.

We claim:

1. A lighter holder to releasably attach a cigarette lighter to a cigarette pack, comprising of a length of elastic material that has first and second opposing ends and a mid-portion positioned between said first and said second opposing ends, the lighter holder further comprising:

a first portion that extends between said first end and said mid-portion, said first end being attached to said mid-portion so said first portion defines a first closed loop that may be stretched from its original size and configuration to circumscribe a perimeter of a preselected cigarette pack, and returns to substantially its original size and configuration when removed from the preselected cigarette pack; and a second portion that extends between said mid-portion and said second end, said second end being attached to said mid-portion so said second portion defines a second closed loop that may be stretched from its original size and configuration to circumscribe a perimeter of a preselected cigarette lighter, and returns to substantially its original size and configuration when removed from the cigarette lighter.

2. A lighter holder to hold a cigarette lighter releasably connected with a cigarette pack, comprising:

a first loop of elastic material that may be stretched from its original size and configuration to circumscribe a perimeter of a preselected cigarette pack and returns to substantially its original size and configuration when removed from the preselected cigarette pack, said first loop having a segment extending along a length of said first loop; and a second loop of elastic material that may be stretched from its original size and configuration to circumscribe a perimeter of a preselected lighter, and returns to substantially its original size and configuration when removed from the lighter, said second loop being connected with said first loop at said segment and extending generally away from said first loop.

* * * * *